US008186065B2

(12) United States Patent
Onion

(10) Patent No.: US 8,186,065 B2
(45) Date of Patent: May 29, 2012

(54) DOUBLE-PIVOT FOLDING KNIFE

(76) Inventor: Kenneth J. Onion, Kaneohe, HI (US)

( * ) Notice: Subject to any disclaimer, the term of this patent is extended or adjusted under 35 U.S.C. 154(b) by 425 days.

(21) Appl. No.: 12/415,943

(22) Filed: Mar. 31, 2009

(65) Prior Publication Data

US 2010/0242288 A1 Sep. 30, 2010

(51) Int. Cl.
*B26B 1/02* (2006.01)

(52) U.S. Cl. ..... 30/155

(58) Field of Classification Search ..... 30/153–161
See application file for complete search history.

(56) References Cited

U.S. PATENT DOCUMENTS

| | | | | |
|---|---|---|---|---|
| 1,864,011 | A * | 6/1932 | Brown | 30/155 |
| 2,265,775 | A * | 12/1941 | McNamara | 30/156 |
| 2,276,026 | A * | 3/1942 | Davidson, Jr. | 30/153 |
| 4,047,298 | A * | 9/1977 | Philippar | 30/153 |
| 4,227,303 | A * | 10/1980 | Brooker | 30/154 |
| 4,606,123 | A * | 8/1986 | Wrench | 30/153 |
| 4,612,706 | A | 9/1986 | Yunes | |
| 4,730,393 | A * | 3/1988 | Coburn | 30/153 |
| D296,657 | S * | 7/1988 | LeFeber | D8/98 |
| 4,974,323 | A | 12/1990 | Cassady | |
| 6,079,106 | A * | 6/2000 | Vallotton | 30/161 |
| 6,289,592 | B1 * | 9/2001 | Emerson | 30/161 |
| 6,523,265 | B2 * | 2/2003 | Eickhorn | 30/161 |
| 7,000,323 | B1 * | 2/2006 | Hatcher et al. | 30/155 |
| 7,107,685 | B1 * | 9/2006 | Anderson | 30/158 |
| 7,152,327 | B2 * | 12/2006 | Rudisill et al. | 30/155 |
| 7,249,417 | B2 * | 7/2007 | Chu | 30/155 |
| 7,555,839 | B2 * | 7/2009 | Koelewyn | 30/160 |
| 7,676,932 | B2 * | 3/2010 | Grice et al. | 30/160 |
| 7,681,316 | B2 * | 3/2010 | Hawk et al. | 30/160 |
| 8,001,693 | B2 * | 8/2011 | Onion | 30/155 |
| 2004/0031155 | A1 * | 2/2004 | Hitchcock et al. | 30/161 |
| 2006/0174490 | A1 * | 8/2006 | Galyean et al. | 30/153 |
| 2007/0124940 | A1 | 6/2007 | Hawk et al. | |
| 2007/0204468 | A1 * | 9/2007 | Cheng | 30/160 |
| 2009/0119926 | A1 * | 5/2009 | Nenadic | 30/161 |

* cited by examiner

*Primary Examiner* — Jason Daniel Prone
(74) *Attorney, Agent, or Firm* — Holland & Hart

(57) ABSTRACT

A folding knife having a handle, a blade pivotably coupled to the handle, and a liner includes a liner lock and a first pivot member that is a post, pin, rod, or other structure having a shape adapted to be slidably received in the second arcuate opening of the blade. The liner further includes a first arcuate opening that has an enlarged end portion and an axis approximately perpendicular to the longitudinal axis of the handle adapted for slidably receiving the second pivot member of the blade. A tang of the blade includes the second pivot member, and the second arcuate opening that has an enlarged end portion and an axis approximately parallel to the longitudinal axis of the blade. An extended tang portion, or flipper, extends downward from the tang. The handle also includes an opposing liner arranged alongside the liner in the handle with the blade positioned therebetween.

10 Claims, 17 Drawing Sheets

DOUBLE-PIVOT FOLDING KNIFE

TECHNICAL FIELD

This invention pertains to cutlery and knives.

BACKGROUND OF THE INVENTION

DESCRIPTION OF THE RELATED ART

FIG. 1 shows a typical fixed-blade knife 100, including a handle 102 and a blade 104. The length of the blade 104 is shown at $B_1$, while the length of the handle 102 is indicated at $H_1$. It can be seen that, in the example illustrated, the blade 104 is longer than the handle 102.

FIG. 2 shows a typical folding knife 200, including a handle 202 and a blade 204. A portion of the handle 202 is shown transparently to show the tang of the blade 204 and the pivot member 208 coupling the blade 204 to the handle 202, and around which the blade 204 rotates to fold into the handle 202. It will be recognized that, in order for the blade 204 to fold into the handle 202, the portion of the blade 204 between the pivot member 208 and the blade point, indicated at $B_2$, must be no longer than the portion of the handle 202 between the pivot member 208 and the heel 205 of the handle 202, indicated at $H_2$. If $B_2$ were longer than $H_2$ the point of the blade would extend beyond the heel 205 of the handle 202 while the knife 200 was folded.

DETAILED DESCRIPTION OF THE INVENTION

A limitation of prior art folding knives is that the length of the blade is limited by the length of the handle, in the relationship described in the background.

Figure 1:
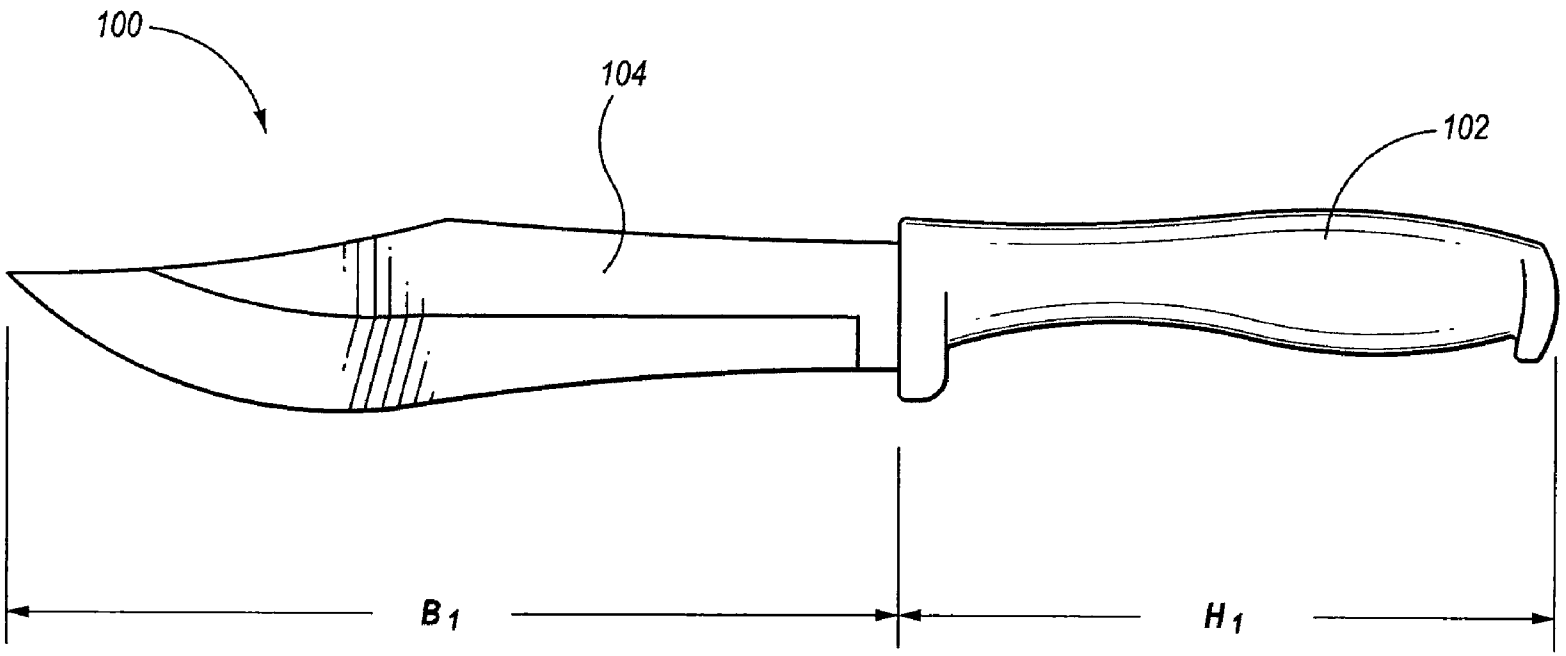
FIG. 1 (Prior Art)
FIG. 1 is an illustration of a typical fixed blade knife.
Figure 2:
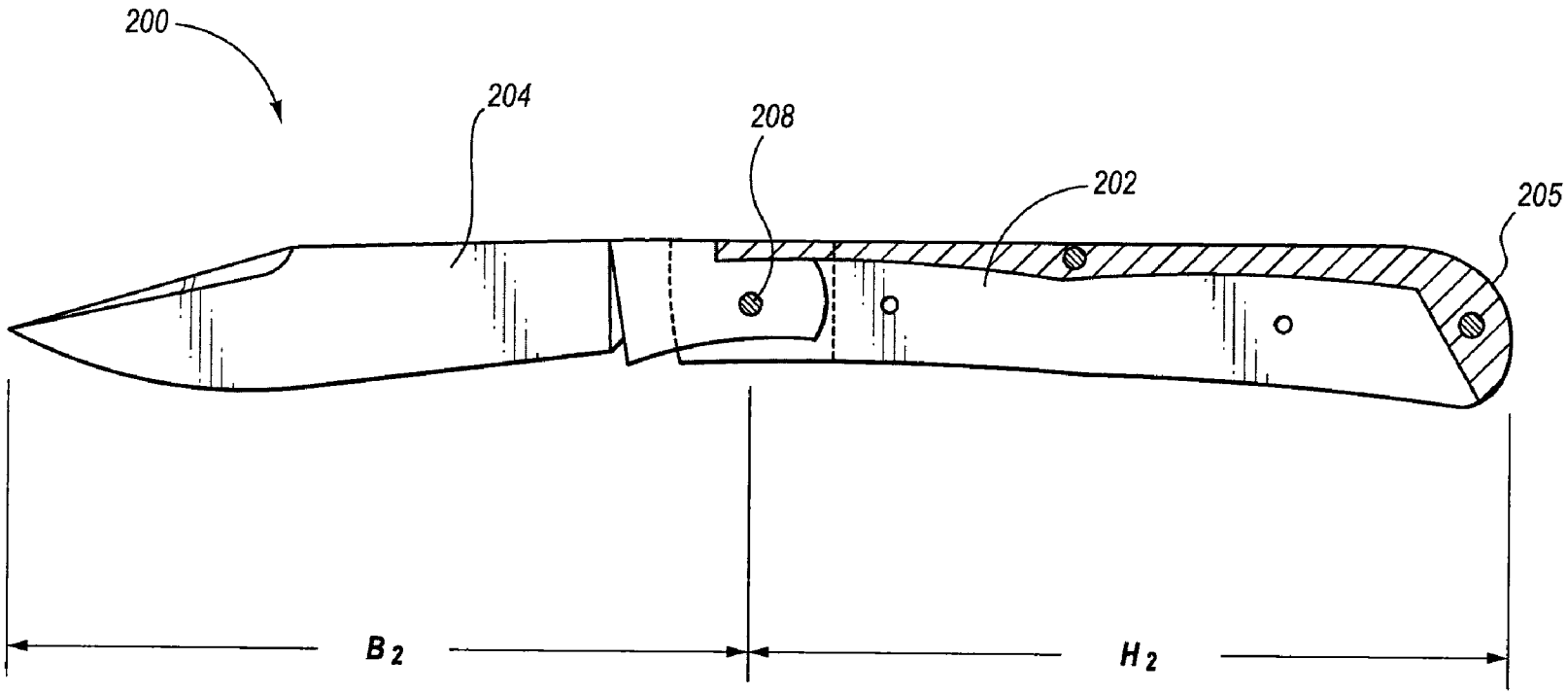
FIG. 2 (Prior Art)
FIG. 2 is an illustration of a typical folding knife.
Figure 3:
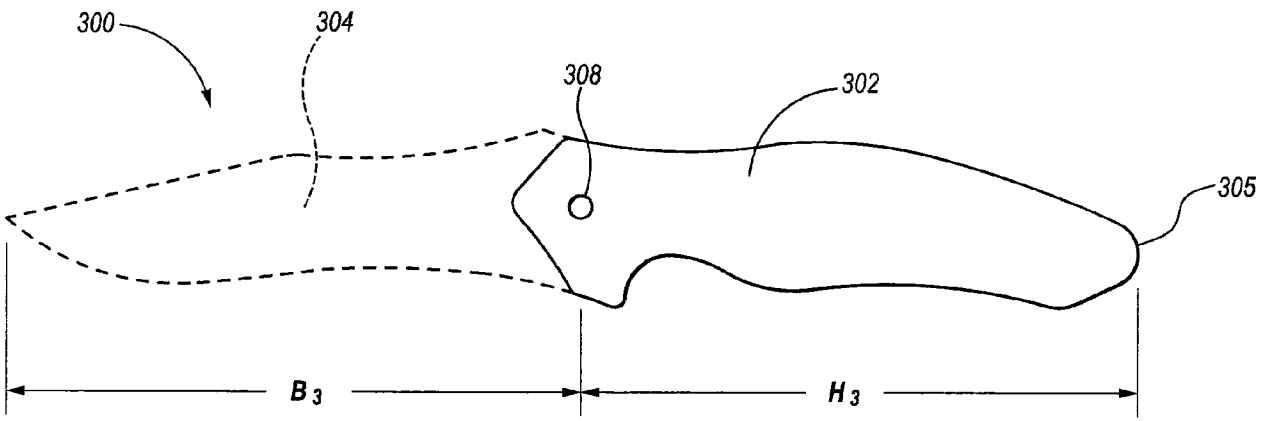
FIG. 3 is an illustration of a certain embodiment of a folding knife of the present invention in the extended position.
Figure 4:
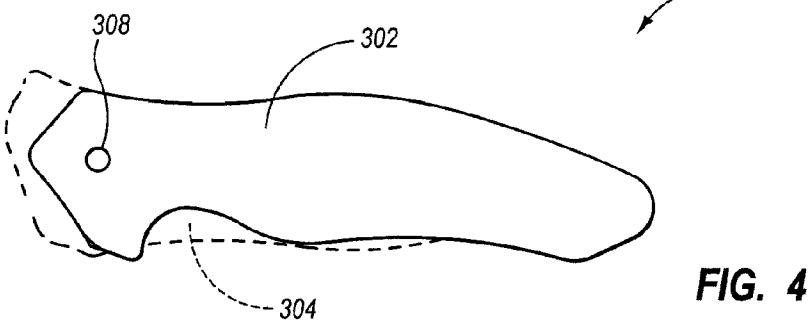
FIG. 4 is an illustration of a certain embodiment of a folding knife of the present invention in the folded position.

FIG. 3 shows a folding knife 300 according to an embodiment of the invention in the extended position, including a handle 302 and a blade 304 pivotably coupled to the handle 302. Comparing a length of the portion of the blade 304 between a pivot member 308 and the blade point, indicated at $B_3$, with a length of the portion of the handle 302 between the pivot member 308 and the heel 305 of the handle, indicated at $H_3$, it can be seen that, in the pictured embodiment, $B_3$ is longer than $H_3$. FIG. 4 shows the folding knife 300 according to an embodiment of the invention in the folded position.

Figure 5:
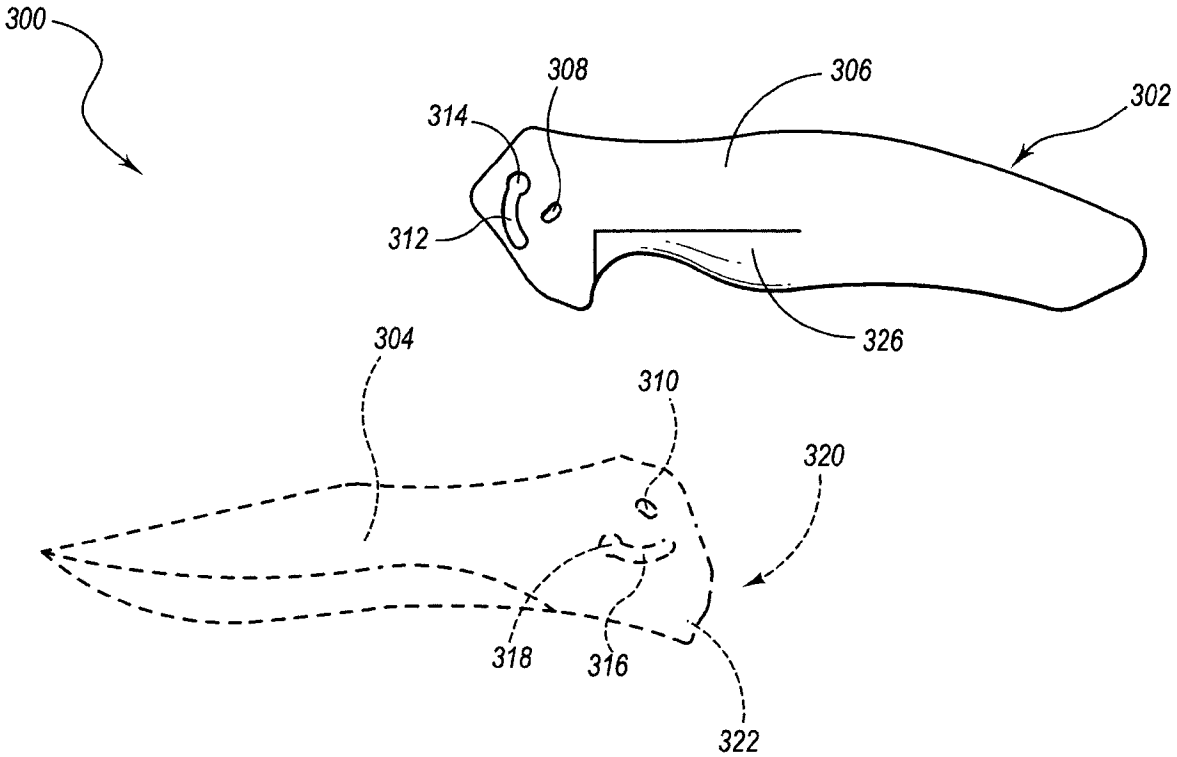
FIG. 5 is an illustration of the components of a certain embodiment of a folding knife of the present invention.

In the description of this and other embodiments, reference to pivot members will be substantially generic. i.e., a post, pin, rod, or other fixture having a shape of the pictured aperture is positioned in each aperture. Referring now to FIG. 5, a liner 306 portion of the handle 302, and blade 304 of the knife 300 are shown. The liner 306 includes a liner lock 326 such as is known in the art. The liner 306 also includes a first pivot member 308, which is a post, pin, rod, or other structure having a shape adapted to be slidably received in a second arcuate opening 316 of the blade 304. The liner 306 further includes a first arcuate opening 312 that has an enlarged end portion 314 and an axis approximately perpendicular to the longitudinal axis of the handle 302. The first arcuate opening 312 is adapted for slidably receiving the second pivot member 310 of the blade 304.

A tang 320 of the blade 304 includes a second pivot member 310, and the second arcuate opening 316 that has an enlarged end portion 318 and an axis approximately parallel to the longitudinal axis of the blade 304. An extended tang portion, or flipper 322, extends downward from the tang 320 as shown in FIG. 5. The handle 302 also includes an opposing liner (not shown) arranged alongside the liner 306 in the handle 302 with the blade 304 positioned therebetween. A backspacer or other means for holding the liners in a spaced-apart relationship is also included, though not shown herein. With the exception of the liner lock 326, features of the opposing liner are substantially identical to those described with reference to liner 306, and one of ordinary skill will understand the structure and operation of the folding knife 300 through a description of the structure and relationship of the liner 306 and blade 304.

The blade 304 is shown in broken lines to assist in differentiating the blade 304 from the liner 306 in figures that follow. Where the features of the blade 304 are small enough that details might be lost in broken lines, the features are shown in solid lines, while the leader lines from reference numbers are still broken. The first and second pivot members 308, 310 are represented in the figures as apertures formed in the respective components. It will be understood that a post, pin, rod, or other fixture having a shape of the pictured aperture is positioned in each aperture.

Figure 6A:
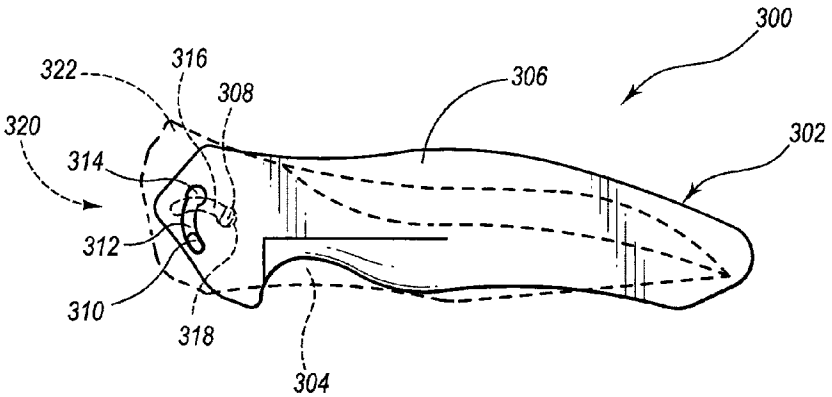
FIGS. 6 A-E are illustrations of a certain embodiment of a folding knife of the present invention in positions ranging from the folded position to the extended position.

Turning now to FIG. 6A, the blade 304 is shown in the folded position relative to the liner 306. The first pivot member 308 extends between the liner 306 and the opposing liner and traverses the second arcuate opening 316 formed in the blade 304. The first pivot member 308 may also extend to the outside of the handle 302, and may have an enlarged head at one end (not shown), and threads (not shown) at the other, to receive a nut or other fastener, in a manner known in the art. The second pivot member 310 extends outward from the blade 304 to the liners and engages the first arcuate opening 312. The first and second pivot members, 308 and 310, respectively, are shaped such that they can rotate only while positioned, respectively, in the enlarged end portions 318, 314 of the second and first arcuate openings 316, 312.

Figure 6B:
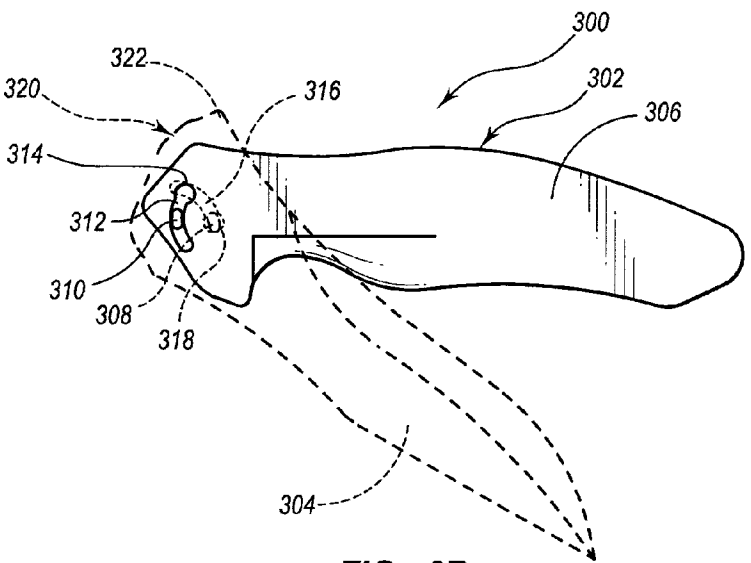

In FIG. 6A, it can be seen that the first pivot member 308 is positioned in the enlarged end portion 318 of the second arcuate opening 316, while the second pivot member 310 is positioned away from the enlarged end portion 314 of the first arcuate opening 312. Accordingly, when the blade 304 is moved away from the closed position shown in FIG. 6A, it rotates on the first pivot member 308 while the second pivot member 310 slides in the first arcuate opening 312, as shown in FIG. 6B. Movement of the blade 304 is easily accomplished by a user by pressing inward (towards liner 306) on the flipper 322.

Figure 6C:
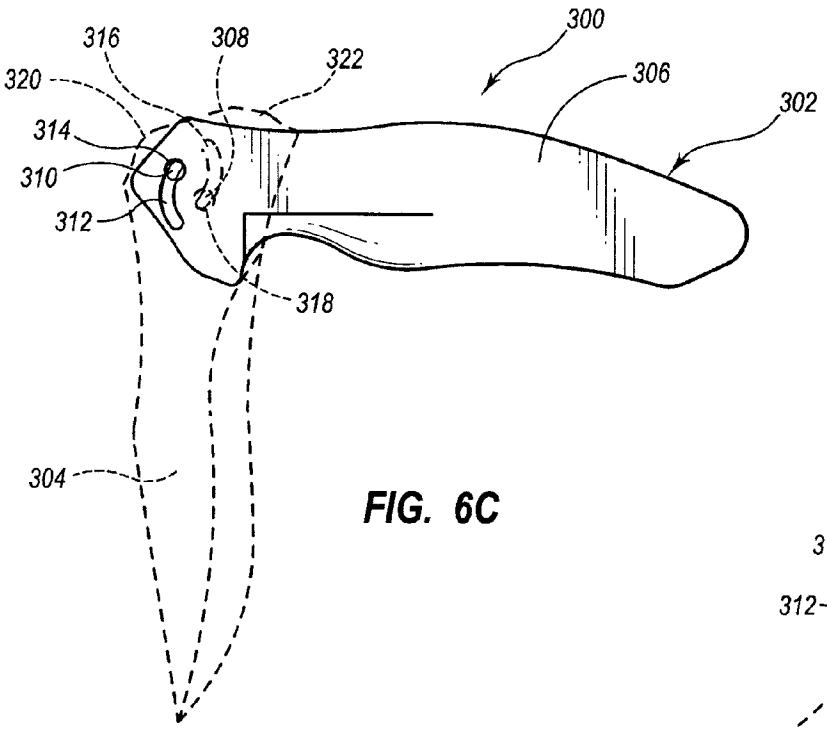
Figure 6D:
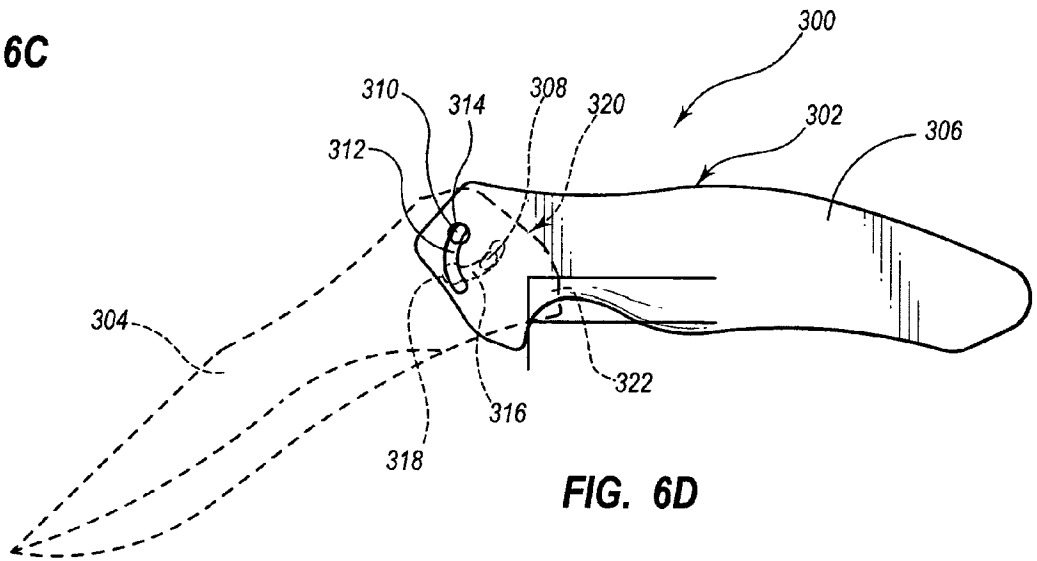
Figure 6E:
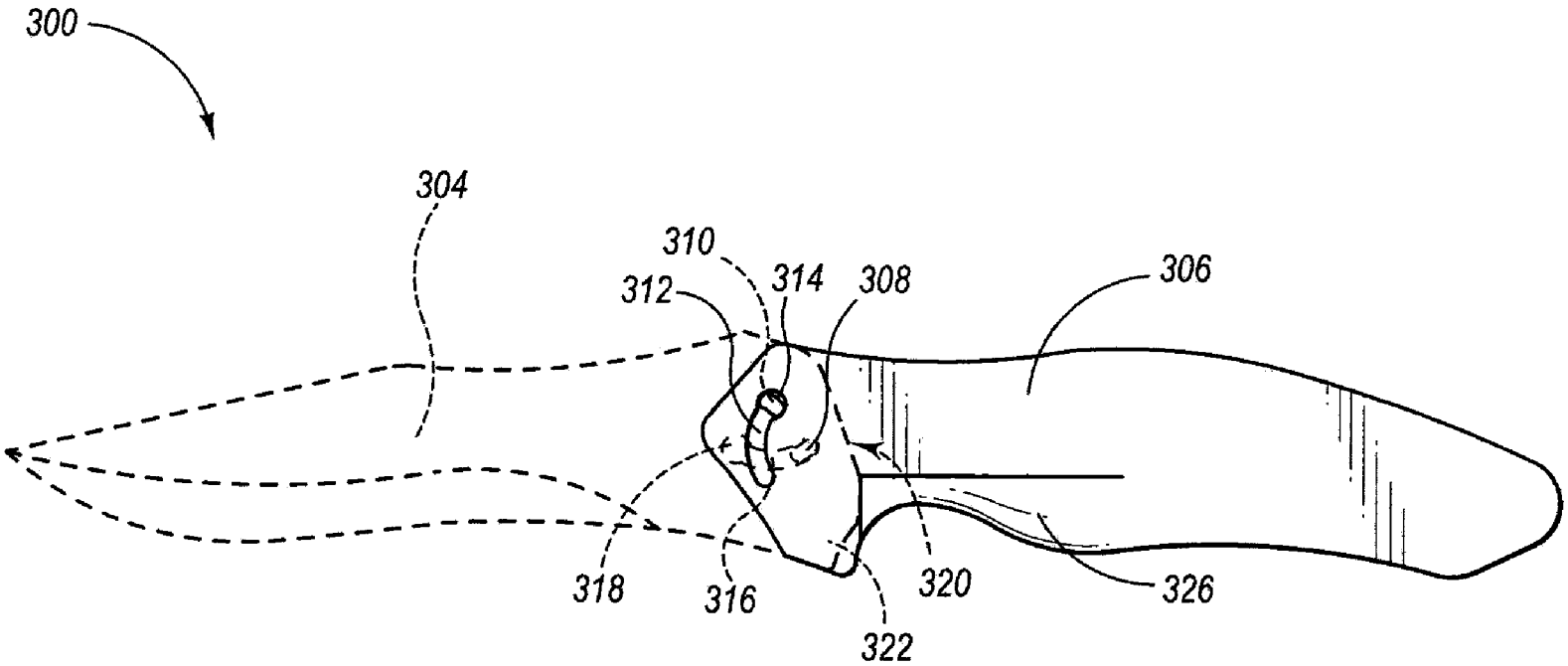

Referring now to FIG. 6C, the blade 304 has been moved approximately halfway from the closed position, as shown in FIG. 6A, toward the open position as shown in FIG. 6E. The second pivot member 310 has entered the enlarged end portion 314 of the first arcuate opening 312, and the blade 304 cannot rotate further on the first pivot member 308. However, at this point in the rotation, the first pivot member 308 is now aligned with the second arcuate opening 316 so that, as the blade 304 is moved further toward the open position, the blade 304 smoothly transitions to rotation around the second pivot member 310 while the first pivot member 308 slides in the second arcuate opening 316, as shown in FIG. 6D. Finally, when the blade 304 fully reaches the open position, as pictured in FIG. 6E, the first pivot member 308 contacts the extreme end of the second arcuate opening 316, which limits further rotation, and the liner lock 326 engages the tang 320 of the blade 304, locking it in the open position.

By comparing FIGS. 6A and 6E, it can be seen that the enlarged end portion 318 of the second arcuate opening 316, which engages the first pivot member 308 while in the closed position, is moved outward from the handle 302 when the blade 304 is in the open position. In moving from the closed to the open position, the blade 304 has also moved this distance outward, and thus is lengthened accordingly.

A knife 700 according to another embodiment of the invention, is illustrated with reference to FIGS. 7A-7E. Because of the different structure of this embodiment, reference numbers are given 7xx prefixes. However, apart from the new prefixes, the numbers indicate the same or equivalent elements.

In this embodiment, the second pivot member 710 is positioned outside the handle, and so, while functioning as a pivot member, it also can function as a thumb stud and/or a stop pin. Accordingly, the end of the liner 706 (and associated handle 702), has an arcuate shape to function as described previously with reference to the first arcuate opening 312. Features 714, 728 of the end portion 712 of the handle serve to limit travel of the pivot member 710. In this embodiment, only the first pivot member 708 is "keyed," i.e., shaped to limit movement within the second arcuate opening 716, to prevent rotation except while in the enlarged end portion 718.

Figure 7A:
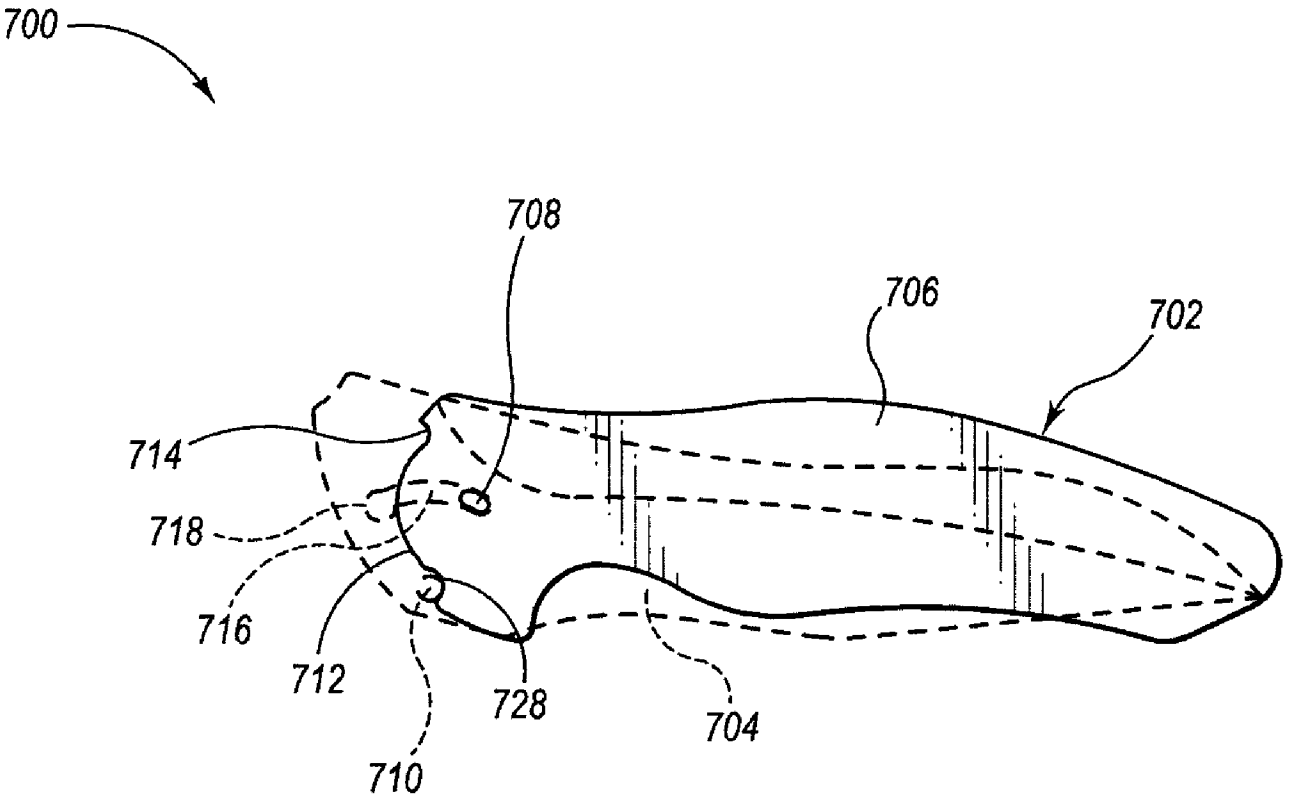
FIGS. 7 A-E are illustrations of another embodiment of a folding knife of the present invention in positions ranging from the folded position to the extended position.
Figure 7B:
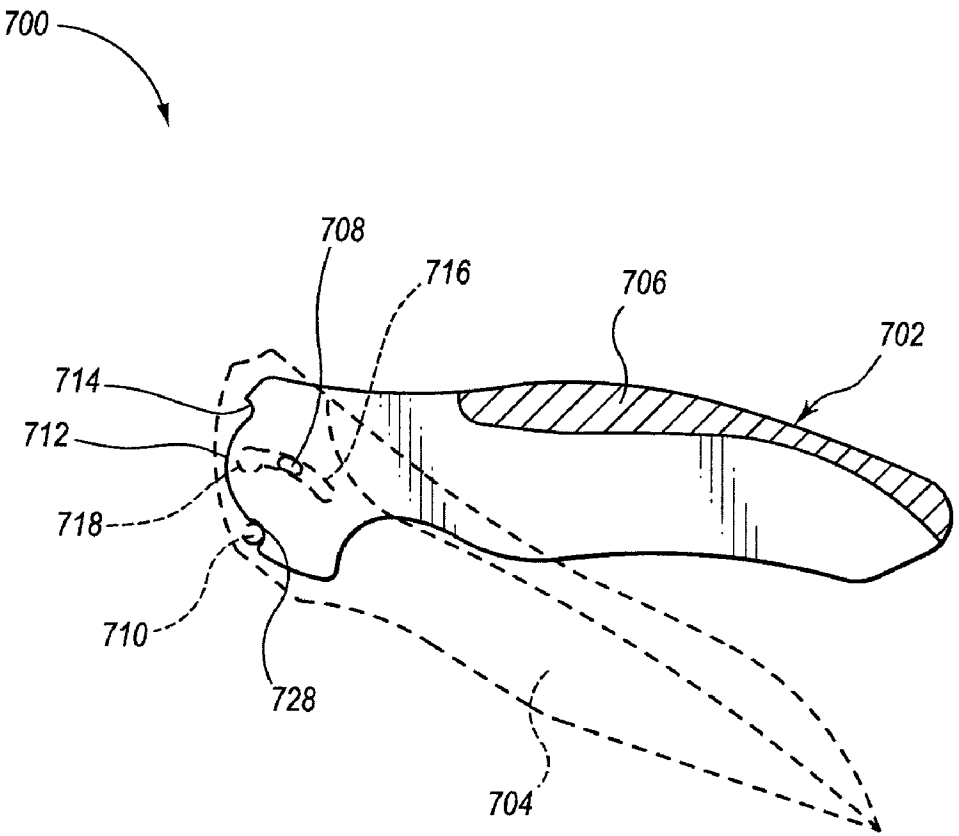
Figure 7C:
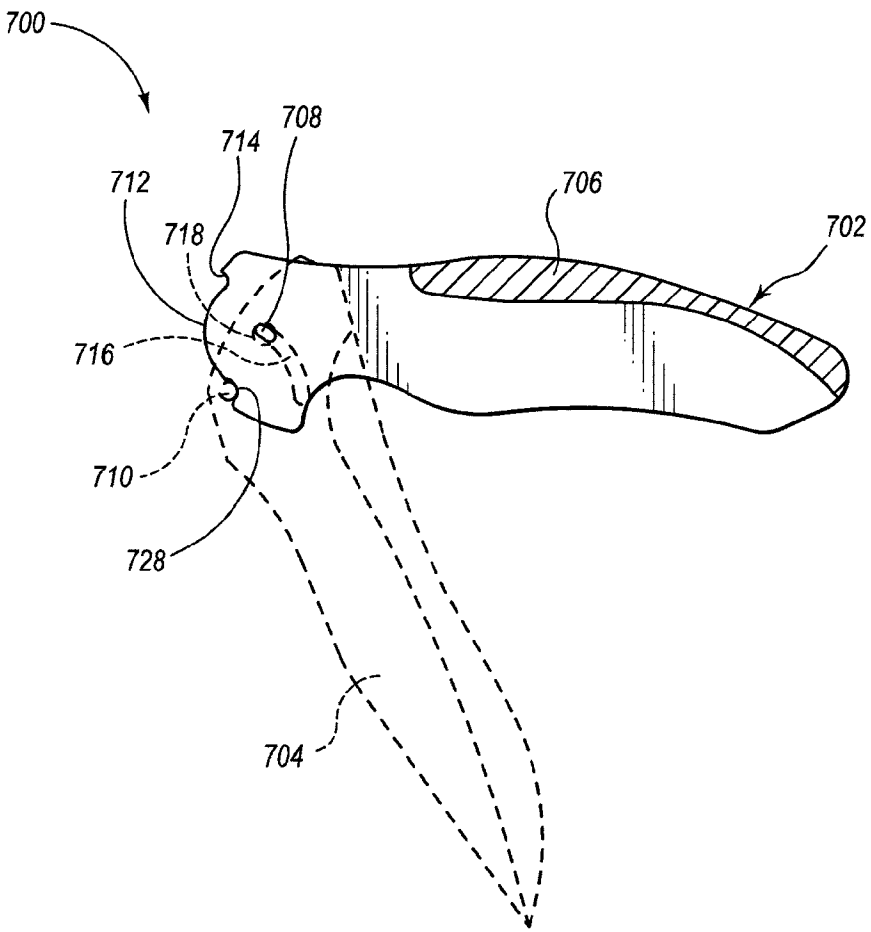
Figure 7D:
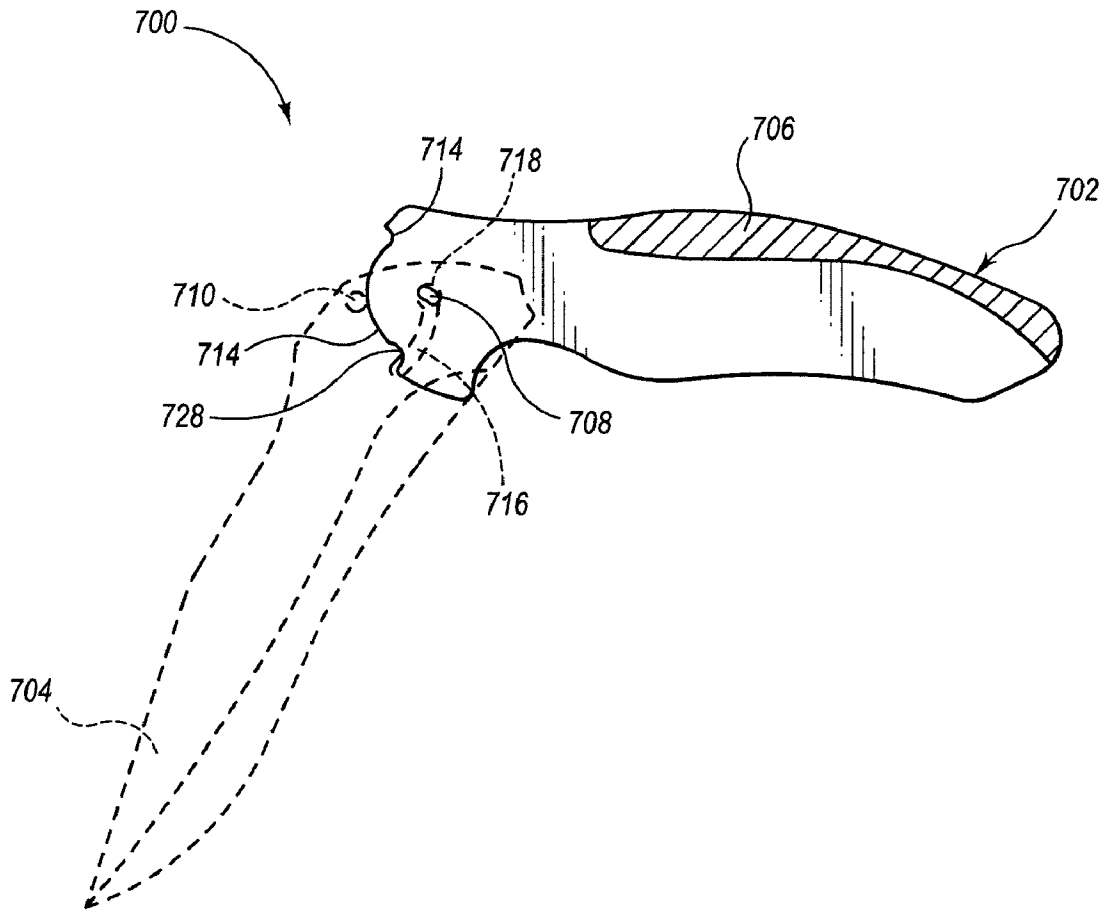
Figure 7E:
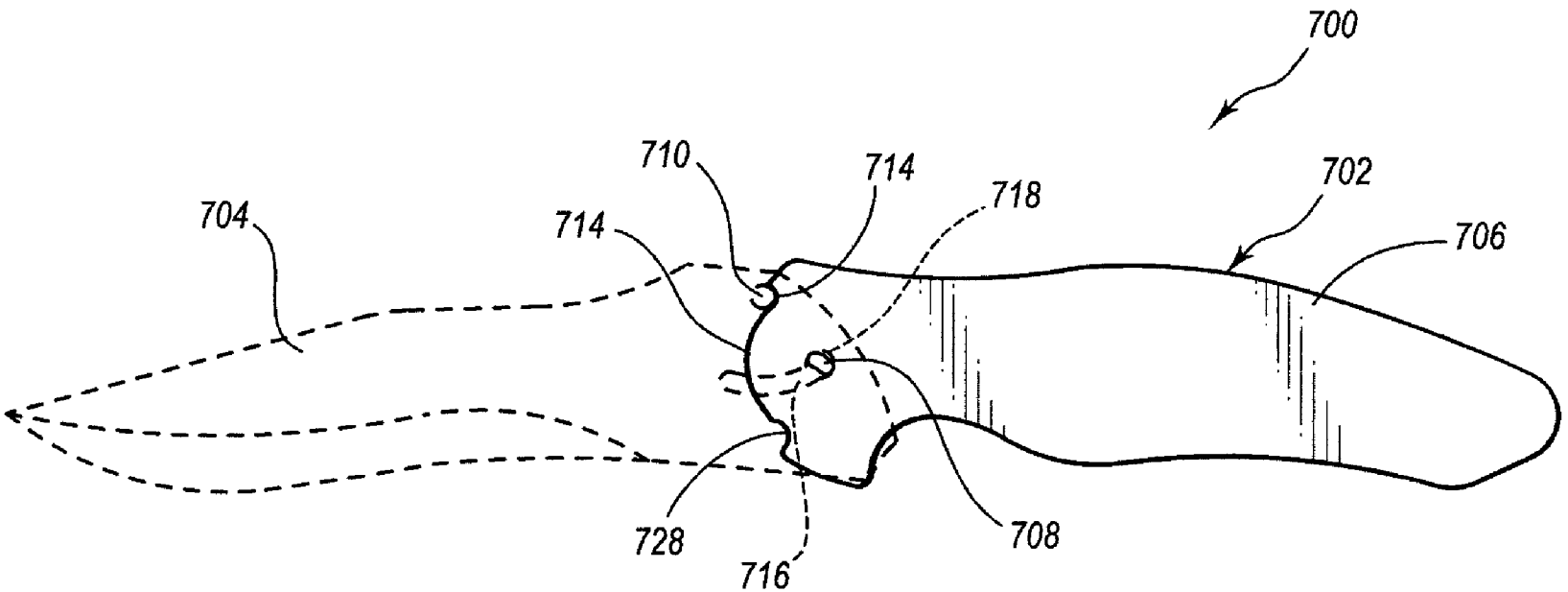
Figure 8B:
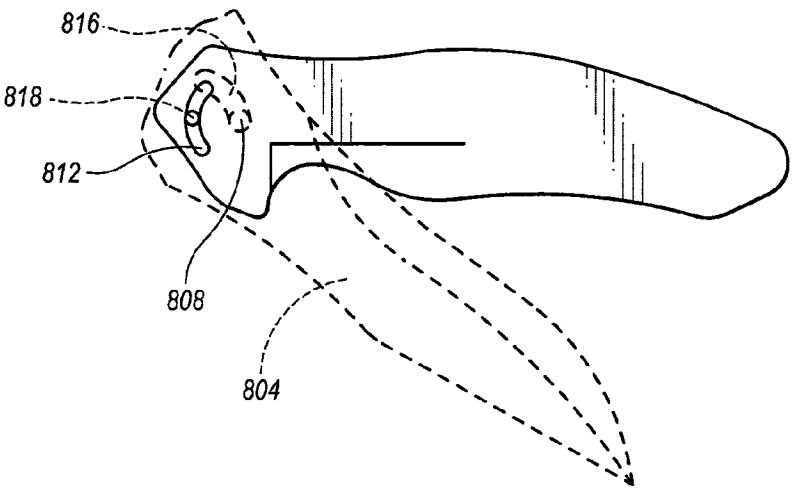
FIGS. 8 A-E are illustrations of another embodiment of a folding knife of the present invention in positions ranging from the folded position to the extended position.
Figure 8A:
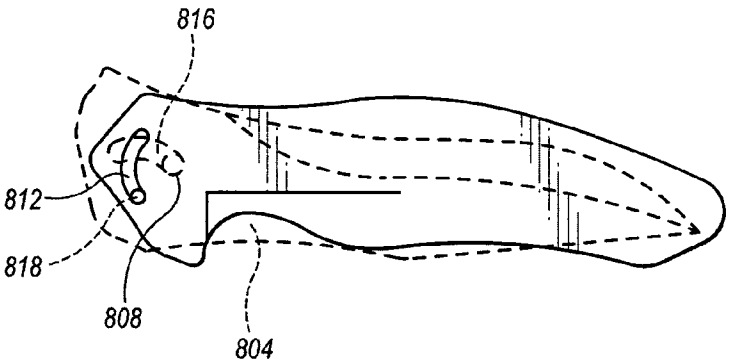
Figure 8C:
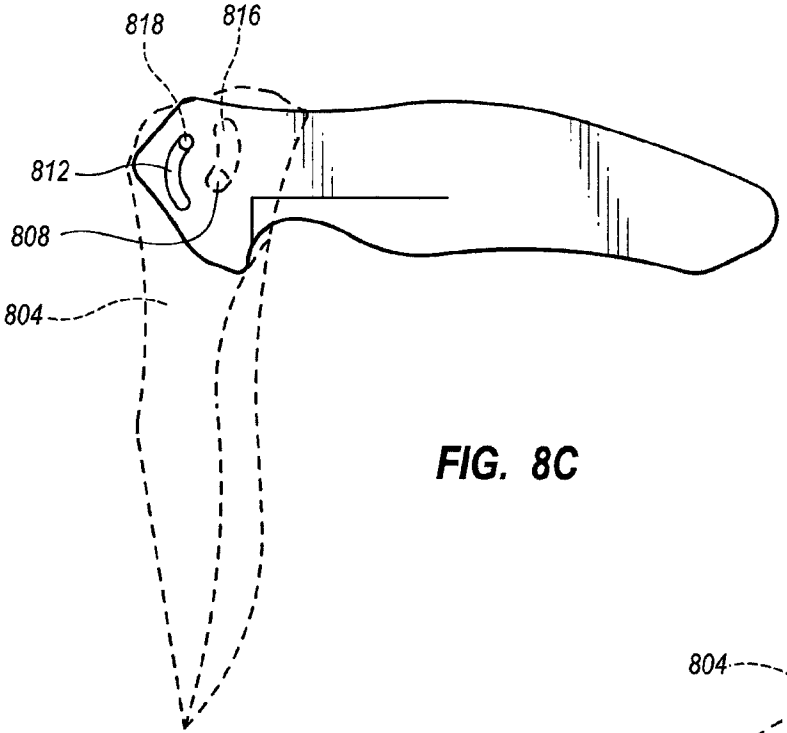
Figure 8D:
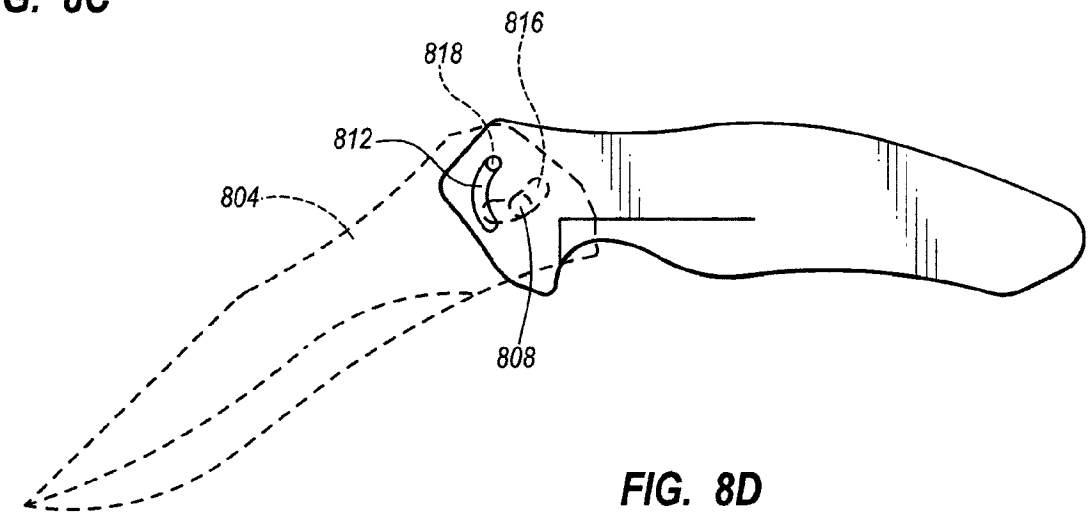
Figure 8E:
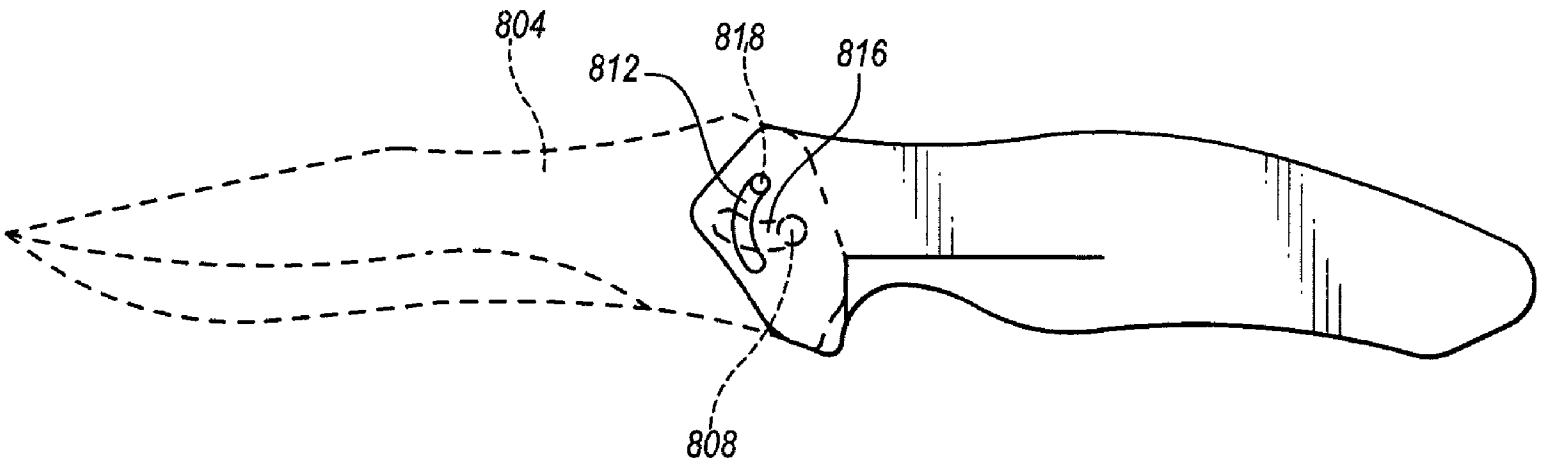

An examination of FIGS. 7A-7E will show that in this embodiment the blade 704 rotates first on the second pivot pin 710 while the first pivot member 708 slides in the second arcuate opening 716, then rotates on the first pivot member 708 when the second pivot pin 710 reaches the end feature 714 of the liner 706 and the first pivot member 708 reaches the enlarged end portion 718 of the second arcuate opening 716, as shown in FIG. 7C.

Referring now to the embodiment of FIGS. 8A-8E, another embodiment is disclosed in which the first and second pivot members 808, 818 are both round, and the first and second arcuate openings 812,816 are without enlarged portions. The opening sequence depicted in the figures shows the blade 804 pivoting on the first pivot member 808, then the second pivot member 818. However, in this embodiment, because there is no keying of either pivot member 808, 818, the blade 804 may pivot on either pivot member 808, 818, or both pivot members 808, 818 simultaneously.

Figure 9B:
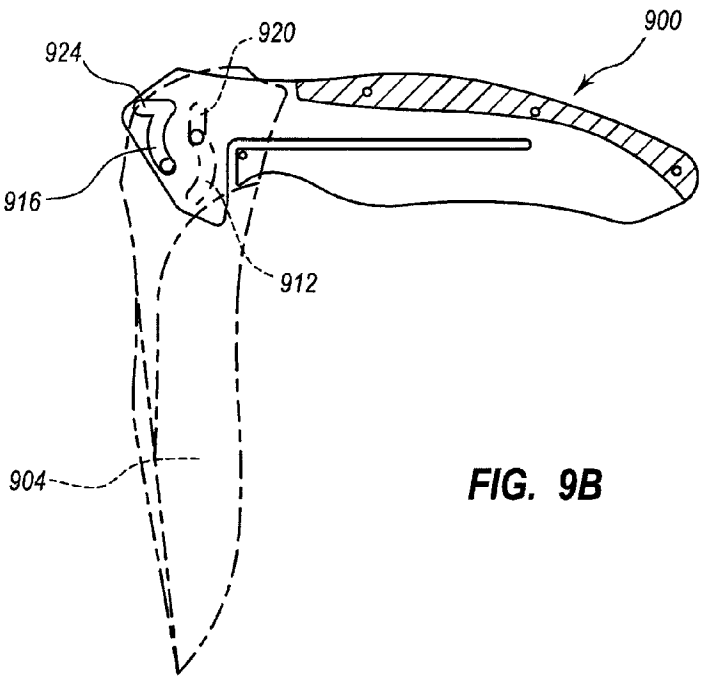
FIGS. 9 A-E are illustrations of another embodiment of a folding knife of the present invention in positions ranging from the folded position to the extended position.
Figure 9A:
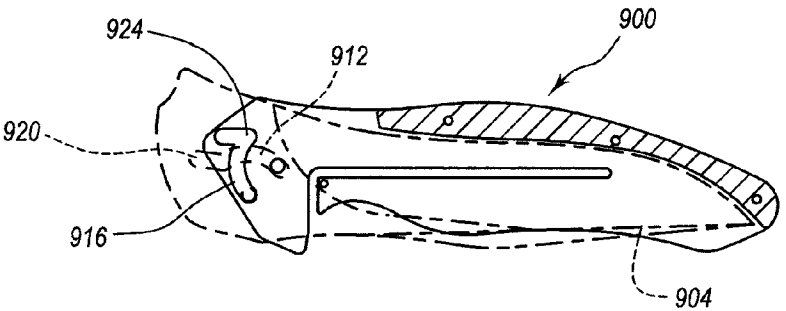
Figure 9E:
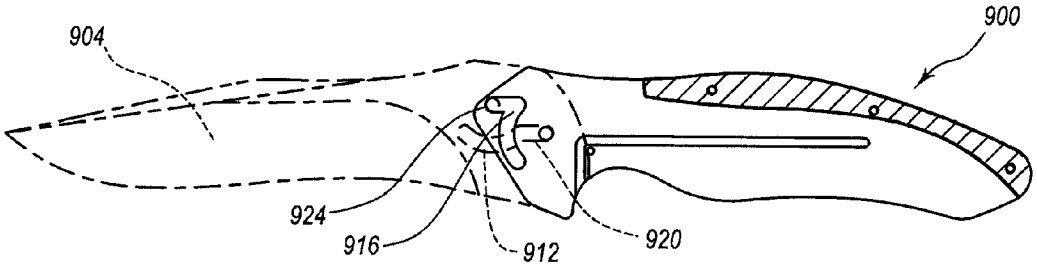
Figure 9D:
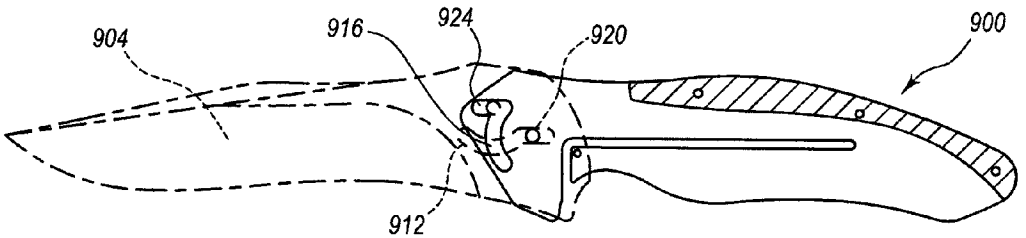
Figure 9C:
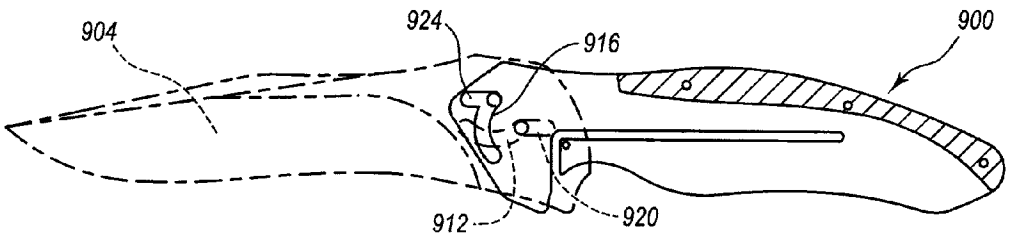

FIGS. 9A-9E show a knife 900 according to a further embodiment of the invention. It can be seen that each of the first and second arcuate openings 912, 916 includes an extension 920,924, such that, when the blade 904 has been fully rotated toward the open position, as shown in FIG. 9E, it can then extend further outward the length of the extension, such that the lengthening of the blade 904 during extension is further increased.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A folding knife, comprising:

a handle; and a blade;

the handle having a first pivot protrusion extending from the handle and a first arcuate opening having a longitudinal axis approximately perpendicular to a longitudinal axis of the handle;

the blade having a second pivot protrusion extending from the blade and a second arcuate opening having a longitudinal axis approximately parallel to a longitudinal axis of the blade;

wherein the first arcuate opening receives the second pivot protrusion and the second arcuate opening receives the first pivot protrusion; and wherein the blade pivots relative to the handle about only one of the pivot protrusions and then about only the other of the protrusions during the pivot.

2. A folding knife, comprising:

a handle; and a blade;

the handle having a pivot member extending from the handle, and an arcuate opening having an axis approximately perpendicular to a longitudinal axis of the handle, for slidably receiving a pivot member extending from the blade; and the blade having an arcuate opening having an axis approximately parallel to a longitudinal axis of the blade, for slidably receiving the pivot member extending from the handle.

3. The folding knife of claim 2 wherein the arcuate opening in the blade has an enlarged end opening.

4. The folding knife of claim 2 wherein the arcuate opening in the handle has an enlarged end opening.

5. The folding knife of claim 2 wherein the arcuate opening in the blade has an extension at an end.

6. The folding knife of claim 5 wherein the extension is linear.

7. The folding knife of claim 6 wherein the linear extension is not approximately parallel to the arcuate opening in the blade.

8. The folding knife of claim 2 wherein the arcuate opening in the handle has an extension at an end.

9. The folding knife of claim 8 wherein the extension is linear.

10. The folding knife of claim 9 wherein the linear extension is not approximately parallel to the arcuate opening in the blade.

* * * * *